US006513836B2

(12) United States Patent
Li

(10) Patent No.: US 6,513,836 B2
(45) Date of Patent: Feb. 4, 2003

(54) PHOTO ALBUM WITH BUILT-IN AUDIO RECORDER

(75) Inventor: Yat Wah Li, Kowloon (HK)

(73) Assignee: Billion Team Limited, Kowloon (HK)

( * ) Notice: Subject to any disclaimer, the term of this patent is extended or adjusted under 35 U.S.C. 154(b) by 0 days.

(21) Appl. No.: 09/864,150

(22) Filed: May 25, 2001

(65) Prior Publication Data

US 2002/0175513 A1 Nov. 28, 2002

(51) Int. Cl.[7] ..... B42D 1/08

(52) U.S. Cl. ..... 281/22; 281/29; 281/51; 402/4; 434/317

(58) Field of Search ..... 281/29, 22, 37, 281/15.1, 21.1, 38, 51; 402/70, 73, 4, 79; 434/317, 309; 40/455

(56) References Cited

U.S. PATENT DOCUMENTS 5,277,452 A * 1/1994 Skidmore ..... 281/31
5,387,108 A 2/1995 Crowell
5,520,544 A * 5/1996 Manico et al. ..... 434/317
6,072,980 A * 6/2000 Manico et al. ..... 434/317
6,148,173 A * 11/2000 Bell ..... 434/317

* cited by examiner

*Primary Examiner*—Willmon Fridie, Jr.
(74) *Attorney, Agent, or Firm*—Leydig, Voit & Mayer, Ltd.

(57) ABSTRACT

A photo album includes front and rear covers, a volume of pages bound between the covers, each page for holding at least one photograph, and an audio recorder for recording an audio message and playing back a recorded message. The recorder includes an electronic control circuit mounted on a printed circuit board affixed to one of the covers, and includes a memory device for storing recorded messages. The recorder includes a microphone and a speaker connected to the control circuit, the microphone and speaker inputting and outputting a message respectively, and at least one electrical switch supported by each separate page. The switch is associated with at least one photograph held by the same page and is connected to the control circuit for triggering the audio recorder to record or play back a message associated with the at least one photograph.

10 Claims, 4 Drawing Sheets

PHOTO ALBUM WITH BUILT-IN AUDIO RECORDER

The present invention relates to a photo album that incorporates a built-in audio recorder.

BACKGROUND OF THE INVENTION

Photo albums are known to incorporate a built-in audio recorder for recording and playing back audio messages associated with the pages and/or photographs, which may include commentary and/or greetings. In a typical arrangement, the recording and playback switches are located on the rear cover and alongside the volume of pages, and an index is provided for associating the playback switches with the respective pages and/or photographs. Such a method of association is not fool proof as it cannot ensure that the correct switch for a particular page or photograph is operated, i.e. a wrong switch may be operated.

The invention seeks to mitigate or at least alleviate such a problem by providing an improved photo album with a built-in audio recorder.

SUMMARY OF THE INVENTION

According to the invention, there is provided a photo album comprising front and rear covers, a volume of pages bound between the covers, each page being adapted to hold at least one photograph, and an audio recorder for recording an audio message and playing back a recorded message. The recorder comprises an electronic control circuit mounted on a printed circuit board affixed to one of the covers, which includes a memory device for storing recorded messages. The recorder includes a microphone and a speaker connected to the control circuit, the microphone and speaker being for input and output of a message, respectively, and at least one electrical switch supported by each separate page for movement therewith. The switch is associated with at least one photograph held by the same page and is connected to the control circuit for triggering the audio recorder to record in a recording mode and play back in a playback mode a message associated with the photograph.

Preferably, each page has opposite sides and holds at least one photograph for display on each opposite side, on which side at least one electrical switch is supported that is associated with the photograph displayed on the same side.

More preferably, the electrical switches for opposite sides of each page are offset in position so as not to overlap with each other.

In a specific construction, each page comprises a pocket having an opening along an edge through which a photograph is insertable into the pocket.

In a preferred embodiment, each page has upper and lower edges and supports at least one electrical switch adjacent one of the upper and lower edges.

More preferably, each page has opposite sides holding at least one photograph for display on each opposite side, on which side at least one electrical switch is supported that is associated with the photograph displayed on the same side, the electrical switches between the opposite sides being supported adjacent the upper and lower edges, respectively.

Further, more preferably, each page comprises a pocket having an opening along an edge thereof through which a photograph is insertable into the pocket.

More preferably, each page comprises a pocket having an opening along an edge thereof through which a photograph is insertable into the pocket, the pocket including a double-walled edge portion encasing the electrical switch associated with the photograph.

More preferably, each page comprises a pocket having an opening along an edge thereof through which one said photograph is insertable into the pocket, said pocket including a double-walled edge portion encasing the electrical switch associated with said photograph.

Further more preferably, the double-walled edge portion extends horizontally across the width of the page and encases co-extensively a strip to which the corresponding electrical switch is attached for being located in position.

It is preferred that the audio recorder include an additional electrical switch connected to the control circuit and affixed to one of the covers for switching the audio recorder from the playback mode to the recording mode.

It is further preferred that the additional electrical switch is arranged to maintain the recording mode for as long as the switch is activated.

In a specific construction, the printed circuit board is located within a substantially flat cabinet mounted on an inner surface of said one of the covers.

More specifically, the cabinet has an edge portion and includes a binder extending along the edge portion and binding the volume of pages together.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
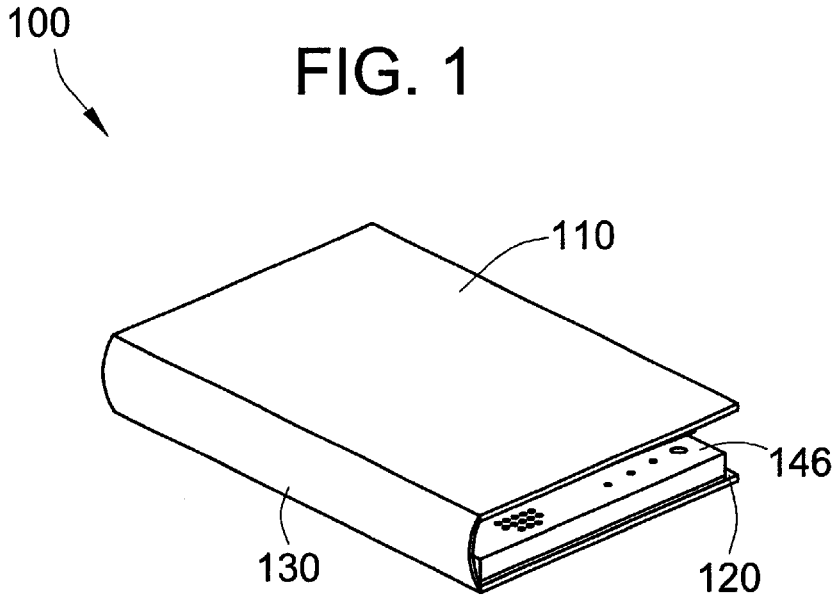
FIG. 1 is a perspective view of an embodiment of a photo album in accordance with the invention.
Figure 2:
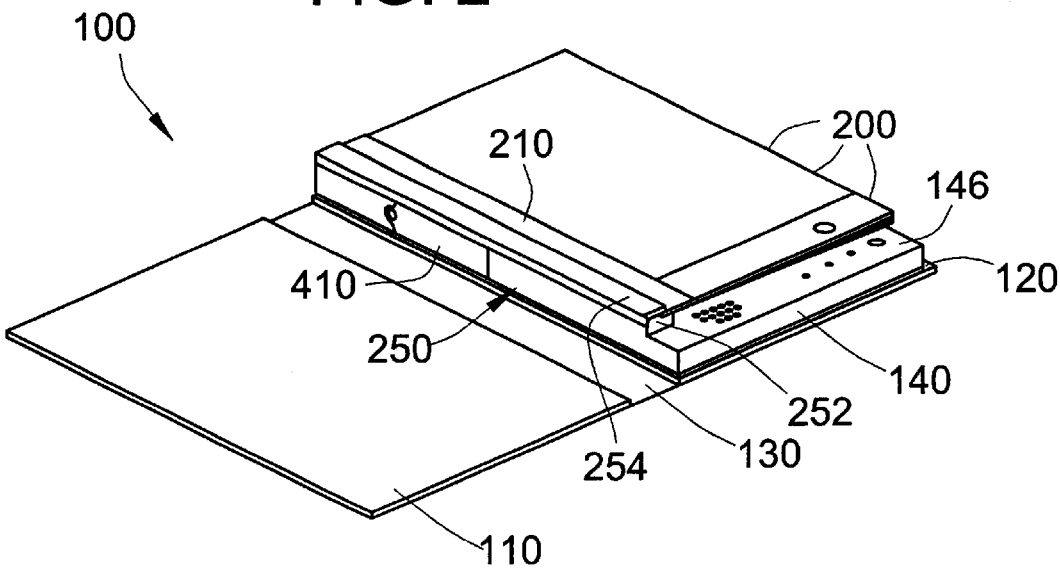
FIG. 2 is a perspective view corresponding to FIG. 1, showing a front cover of the photo album lying flat open.
Figure 3:
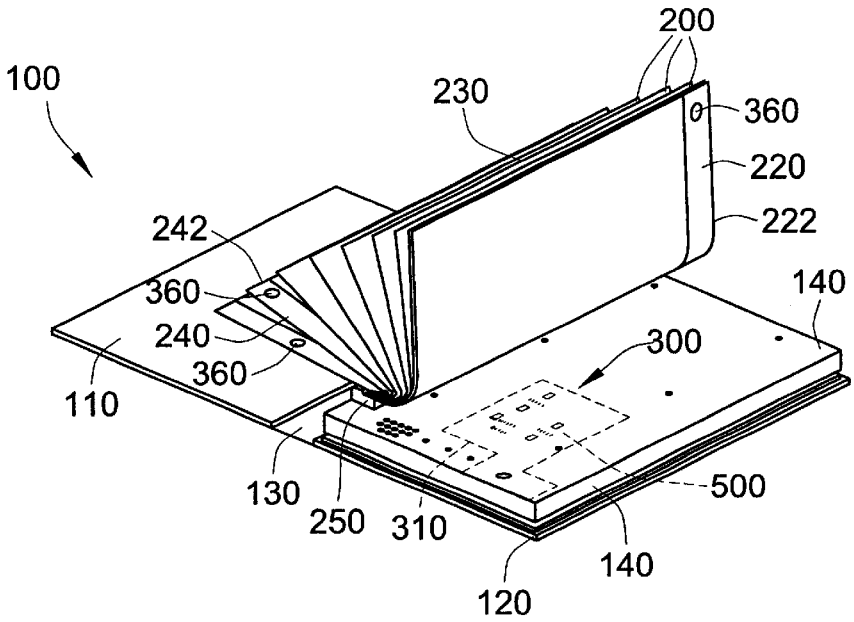
FIG. 3 is a perspective view corresponding to FIG. 2, showing pages of the photo album open and revealing the inner side of a rear cover.
Figure 4:
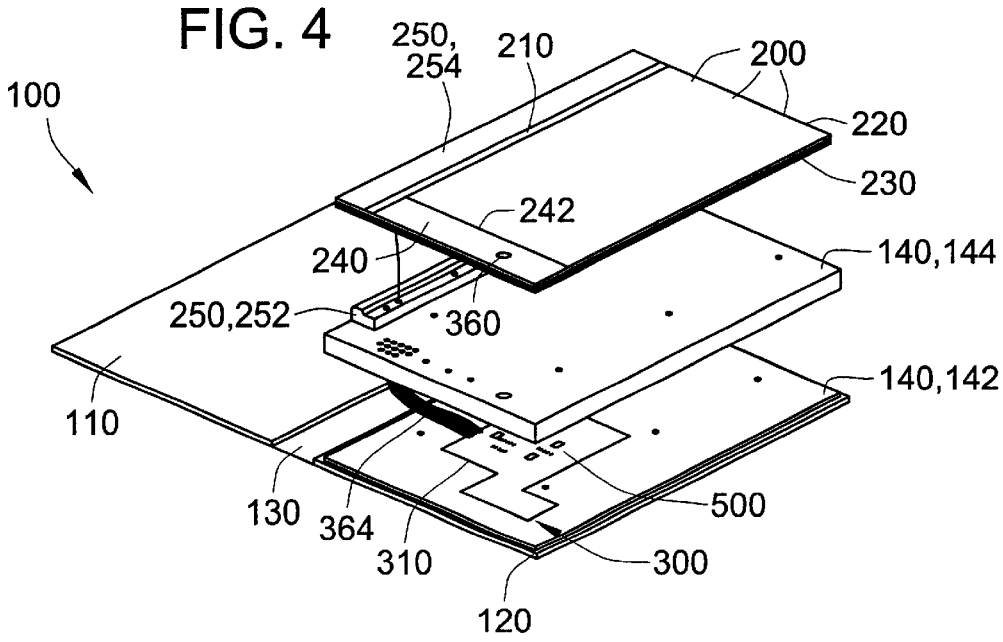
FIG. 4 is a perspective view corresponding to FIG. 3, showing the pages of the photo album being separated and the rear cover exploded to reveal an audio recorder located within the rear cover.
Figure 5:
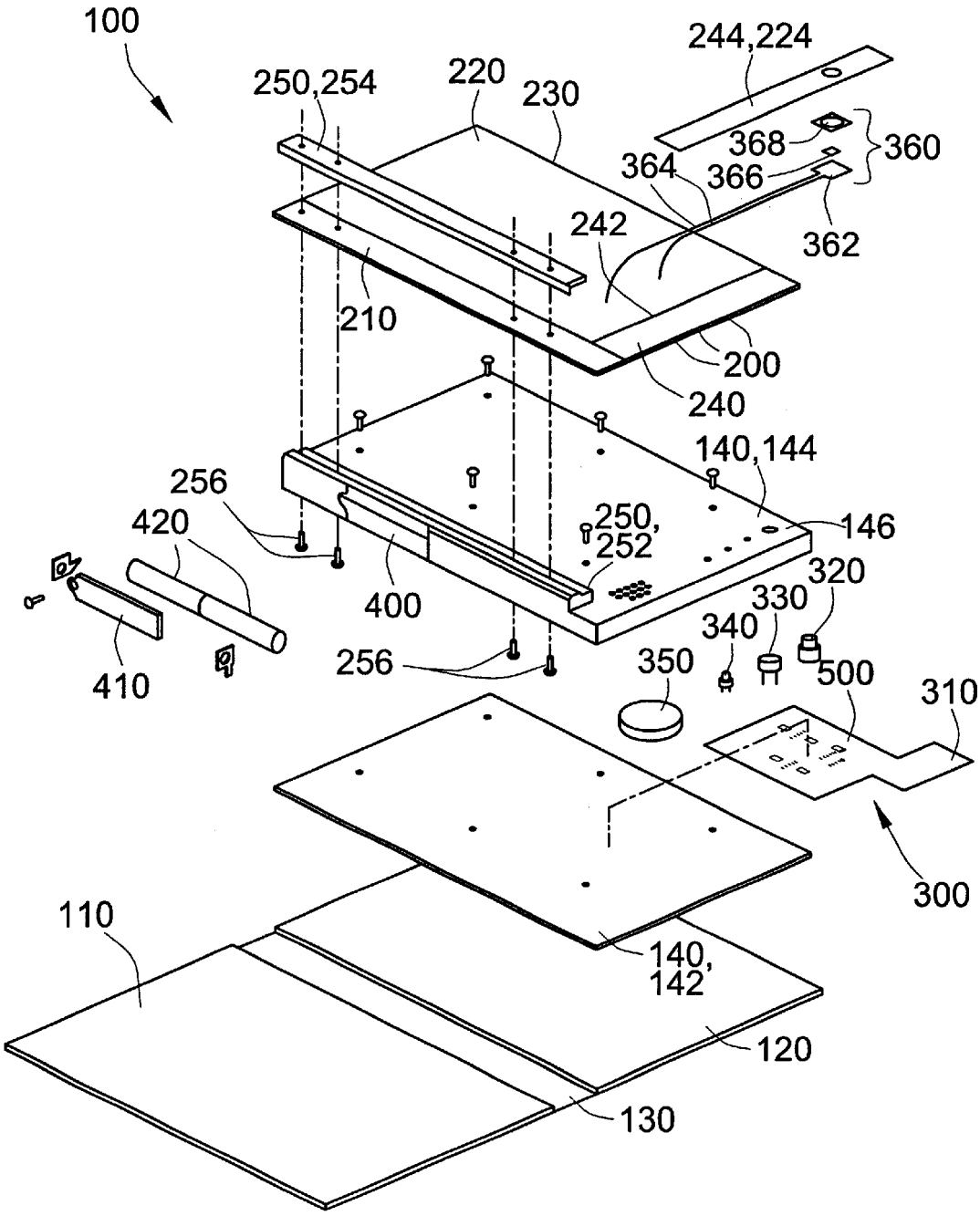
FIG. 5 is an exploded perspective view corresponding to FIG. 4, showing how the various components of the photo album are assembled.

Referring initially to FIGS. 1 to 5 of the drawings, there is shown a photo album 100 embodying the invention, which album 100 comprises a hard jacket formed by front and rear covers 110 and 120 and an integral web 130 therebetween, a volume of twelve pages in the form of transparent pockets 200, and a binder 250 located on the inside of the rear cover 120 and binding the pockets 200 together. A flat rectangular cabinet 140 is mounted on the inner surface of the rear cover 120, occupying almost the entire inner surface. The cabinet 140 consists of a base plate 142 attached to the inner surface and a hollow top cover 144 closing onto the base plate 142. The album 100 includes a built-in audio recorder 300 located within the cabinet 140 for recording and playing back audio messages.

The binder 250 is formed by a lower strip 252 integrally moulded on and along the left edge portion of the cabinet top cover 144 and a loose upper strip 254 secured to the lower strip 252 by means of four screws 256 from below, thereby clamping the pockets 200 together by one side edge portions 210. A battery compartment 400 having a side door 410 is defined within the cabinet 140, at a position immediately underneath the lower strip 252, for holding two battery cells 420.

The audio recorder 300 is implemented by a control circuit 500 (FIG. 6) mounted on a printed circuit board or PCB 310. The recorder 300 includes a press-knob electrical switch 320 for recording, a microphone 330 for audio input, a light-emitting diode or LED 340 for recording indication, a speaker 350 for audio output, and a set of twenty four small flat electrical switches 360 for playback/recording. The PCB 310 is mounted on the cabinet base plate 142. The press-knob switch 320, microphone 330, LED 340 and speaker 350 are located within a lower edge portion 146 of the cabinet top cover 144, which is in turn formed with suitable apertures as shown to expose such components for operation. The lower edge portion 146 protrudes beyond the lower edges of the pockets 200 such that the said components will not be covered by the pages 200.

Each pocket 200 is adapted to hold two photographs for display on opposite front and rear sides thereof, and one flat switch 36 is physically associated with each pocket side for the photograph displayed thereon.

Apart from the side edge portion 210, each pocket 200 includes a top edge or edge portion 220 formed with an opening for the insertion of photographs into the pocket 200, a closed opposite side edge 230, and a bottom edge or edge portion 240. On the front side of the pocket 200, the bottom edge portion 240 has a double-walled structure to form a pouch 242 encasing a marginally smaller paper strip 244. On the rear side of the pocket 200, the top edge portion 220 has a double-walled structure to form a similar pouch 222 encasing a similar paper strip 224. The pouches 222 and 242 extend horizontally across the width of the pocket 200. A flat switch 360 is located by the paper strip 244 within the bottom pouch 242 for the photograph on the front pocket side, and another flat switch 360 is located by the paper strip 224 within the top pouch 222 for the photograph on the rear pocket side.

Each flat switch 360 is formed by a PCB 362, a pair of wires 364 having respective ends as contacts fixed on the PCB 362, a popping contact sheet 366 overlying the fixed contacts, and a paper washer 368 locating the contact sheet 366 and adhered to the PCB 362. The washer 368 is adhered to the underside of the respective paper sheet 224/244, whereby the overall flat switch 360 is located at a specific position within the pouch 222/242. The switch 360 is normally open and may be closed by being squeezed or pressed to move the contact sheet 366 to short-circuit the two fixed contacts.

As each flat switch 360 is relatively thicker than the associated pocket 200, the switches 360 as between adjacent pockets 200 are offset along the length of the pouch 222/242 to avoid overlapping such that their thickness does not add up. The offset arrangement also assists in reducing the risk of unintentional closing of a lower switch 360 by an upper switch 360 upon pressing.

Figure 6:
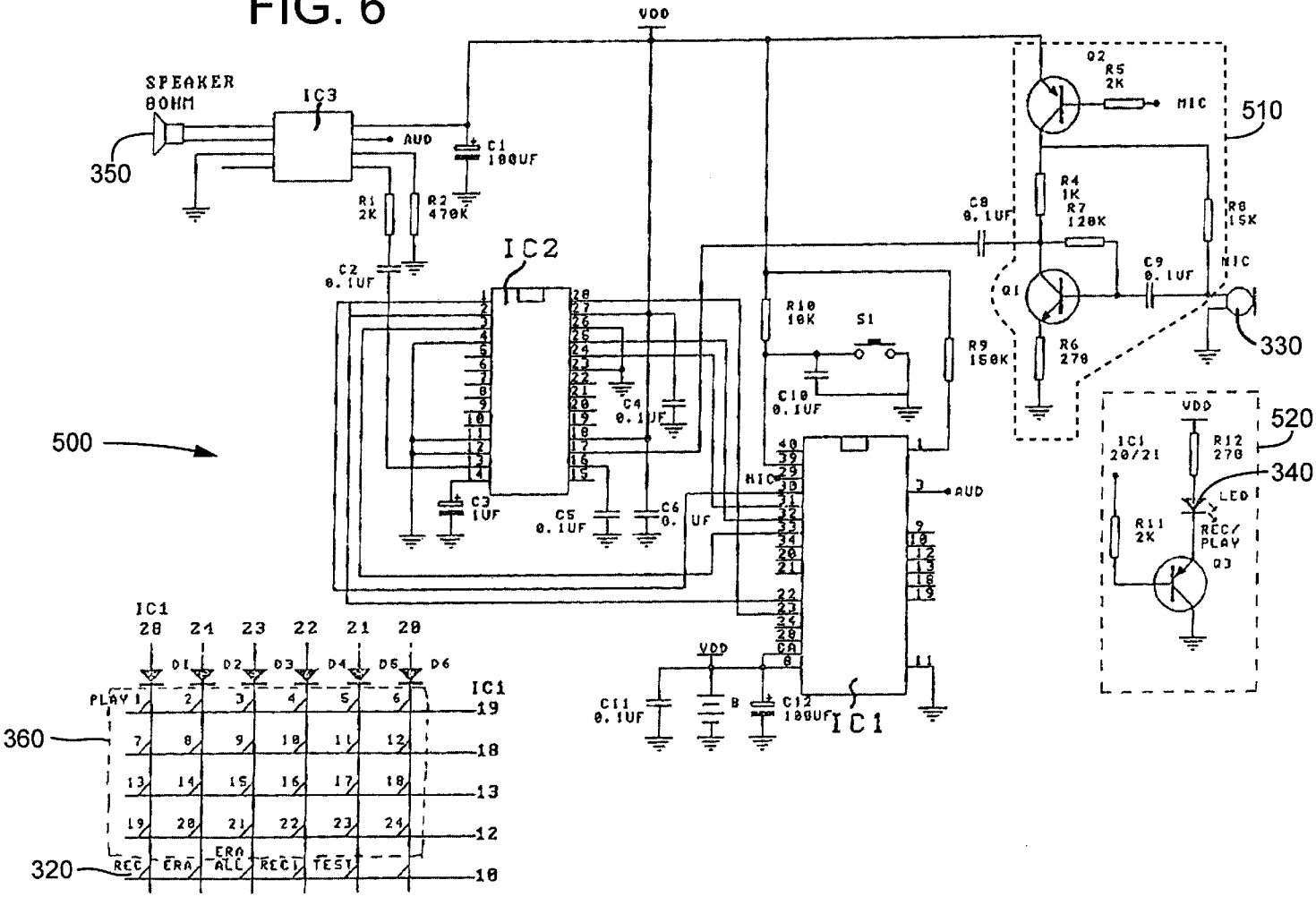
FIG. 6 is a circuit diagram of an electronic control circuit of the audio recorder.

Referring now to FIG. 6, the control circuit 500 comprises a program chip IC1 as the CPU, a memory chip IC2 for storing the recorded audio messages, a transistor-based amplifier 510 for the microphone 330, a driver 520 for the LED 340, and an amplifier chip IC3 for the speaker 350, all being connected as shown. The flat switches 360 are connected together in a six-by-four matrix form, which together with the press-knob switch 320 and certain other switches are connected to the appropriate pins of the program chip IC1 as identified.

The audio recorder 300 has playback and recording modes. In the playback mode, which is the normal operating mode, pressing of any one flat switch 360 will trigger the control circuit 500 to play back, by means of the speaker 350, a message pre-recorded in relation to the relevant photograph, i.e. the photograph that is adjacent the switch 360 concerned. Upon depression of the press-knob switch 320, the recorder 300 will be switched from the playback mode into the recording mode, for as long as the switch 320 is kept being depressed. In the recording mode, pressing of any one flat switch 360 will trigger the control circuit 500 to record, by means of the microphone 330, a message of the user associated with the relevant photograph, i.e. the photograph that is adjacent the switch 360 concerned. The recorder 300 will be returned to the playback mode as soon as the press-knob switch 320 is released.

The audio recorder 300 of the subject photo album 100 is advantageous in the sense that it ensures (1) playback of the correct message for an intended photograph (or photograph position) and (2) recording of a message for the correct photograph. This is achieved by reason of the relevant switch 360 being located on the same page and/or adjacent the photograph, such that the switch 360 will move/flip with the page.

It is of course possible that each page (side) is adopted to hold two or more photographs, in which case the same number of switches 360 should be used, with each of them located next to a corresponding photograph.

The invention has been given by way of example only, and various other modifications of and/or alterations to the described embodiment may be made by persons skilled in the art without departing from the scope of the invention as specified in the appended claims.

What is claimed is:

1. A photo album comprising front and rear covers, a plurality of pages, bound between the front and rear covers, each page comprising a pocket having an opening along an edge through which a photograph is insertable into the pocket, the pocket including a double-walled edge portion, and an audio recorder for recording an audio message and playing back a recorded message, the recorder comprising an electronic control circuit mounted on a printed circuit board affixed to one of the front and rear covers, the electronic control circuit including a memory device for storing recorded messages, a microphone and a speaker connected to the electronic control circuit, the microphone and speaker for inputting and outputting a message, respectively, and respective electrical switches encased in the doubled walled edge portion of the pocket of a corresponding page and moving with the page, each switch being associated with at least one photograph held by the corresponding page and connected to the electronic control circuit for triggering the audio recorder to record in a recording mode and play back in a playback mode a message associated with the at least one photograph in the pocket, each electrical switch being substantially flat and comprising at least one fixed contact, a movable contact, and an actuating member resiliently biased and actuable to move the movable contact into contact with the fixed contact momentarily.

2. The photo album as claimed in claim 1, wherein each page has opposite sides for holding at least one photograph for display on each opposite side, on which side the electrical switch associated with the at least one photograph displayed is supported.

3. The photo album as claimed in claim 2, wherein the electrical switches on opposite sides of each page are offset in position and do not overlap with each other.

4. The photo album as claimed in claim 1, wherein each page has upper and lower edges and supports at least one electrical switch adjacent one of the upper and lower edges.

5. The photo album as claimed in claim 4, wherein each page has opposite sides for holding at least one photograph for display on each opposite side, on which side the electrical switch associated with the at least one photograph displayed on the same side is supported, electrical switches on opposite sides being supported adjacent the upper and lower edges, respectively.

6. The photo album as claimed in claim 1, wherein the double-walled edge portion extends across a width of the page and encases co-extensively a strip to which the corresponding electrical switch is attached and thereby located in position.

7. The photo album as claimed in claim 1, wherein the audio recorder includes an additional electrical switch connected to the electronic control circuit and affixed to one of the front and rear covers for switching the audio recorder from the playback mode to the recording mode.

8. The photo album as claimed in claim 7, wherein the additional electrical switch maintains the recording mode only as long as the additional switch is actuated.

9. The photo album as claimed in claim 1, including a substantially flat cabinet mounted on an inner surface of one of the front and rear covers and in which the printed circuit board is located.

10. The photo album as claimed in claim 9, wherein the cabinet has an edge and includes a binder extending along the edge and binding the pages together.

* * * * *